US009071008B2

(12) United States Patent
Zillinger et al.

(10) Patent No.: US 9,071,008 B2
(45) Date of Patent: Jun. 30, 2015

(54) CABLE CONNECTION SYSTEM

(71) Applicants: Friedrich Zillinger, Armstrong (CA); Cedric Doerksen, Calgary (CA)

(72) Inventors: Friedrich Zillinger, Armstrong (CA); Cedric Doerksen, Calgary (CA)

(73) Assignee: Geo Pressure Systems Inc. (CA)

( * ) Notice: Subject to any disclaimer, the term of this patent is extended or adjusted under 35 U.S.C. 154(b) by 71 days.

(21) Appl. No.: 14/058,701

(22) Filed: Oct. 21, 2013

(65) Prior Publication Data

US 2015/0111420 A1 Apr. 23, 2015

(30) Foreign Application Priority Data

Oct. 15, 2013 (CA) ..... 2826753

(51) Int. Cl.

| | |
|---|---|
| ***H01R 13/58*** | (2006.01) |
| ***H01R 13/52*** | (2006.01) |
| ***H01R 13/533*** | (2006.01) |
| ***H01R 43/00*** | (2006.01) |
| ***H01R 13/59*** | (2006.01) |
| ***H01R 13/523*** | (2006.01) |
| ***E21B 43/12*** | (2006.01) |

(52) U.S. Cl.

CPC ..... *H01R 13/533* (2013.01); *H01R 43/005* (2013.01); *H01R 13/59* (2013.01); *H01R 13/523* (2013.01); *E21B 43/123* (2013.01)

(58) Field of Classification Search

USPC ..... 439/460, 461, 271, 272, 278, 279, 738, 439/578–595.191, 194, 521; 174/88 R, 76, 174/91, 93; 166/65.1, 242.6

See application file for complete search history.

(56) References Cited

U.S. PATENT DOCUMENTS

| | | | | |
|---|---|---|---|---|
| 5,485,745 | A * | 1/1996 | Rademaker et al. | 73/152.39 |
| 5,642,780 | A * | 7/1997 | Moore | 166/65.1 |
| 5,667,008 | A * | 9/1997 | Moore | 166/65.1 |
| 5,833,490 | A | 11/1998 | Bouldin | |
| 6,062,905 | A * | 5/2000 | Sampa et al. | 439/587 |
| 6,362,428 | B1 | 3/2002 | Pennington | |
| 7,405,358 | B2 * | 7/2008 | Emerson | 174/88 R |
| 7,980,873 | B2 | 7/2011 | Emerson | |
| 8,246,371 | B2 | 8/2012 | Emerson | |
| 8,297,345 | B2 | 10/2012 | Emerson | |
| 8,382,508 | B1 * | 2/2013 | Frey et al. | 439/461 |
| 2008/0185155 | A1 * | 8/2008 | Emerson | 166/378 |

* cited by examiner

*Primary Examiner* — Abdullah Riyami
*Assistant Examiner* — Harshad Patel
(74) *Attorney, Agent, or Firm* — Terrence N. Kuharchuk; Rodman & Rodman

(57) ABSTRACT

A cable connection system for connecting a metal jacketed electrical cable with a primary housing, including a socket electrical connector contained within a primary housing bore, a pin electrical connector connected with the cable, a rigid electrical insulating sleeve extending between the pin electrical connector and the metal jacket, and a primary housing compression fitting for mechanically connecting the cable with the primary housing. The cable connection system may further include a secondary housing mechanically connected with the primary housing and a secondary housing compression fitting for mechanically connecting the cable with the secondary housing. A method for assembling the cable connection system including preparing the cable and the pin electrical connector for use, extending the pin electrical connector through the compression fittings and the housing bores to electrically connect the pin electrical connector and the socket electrical connector, connecting the housings, and tightening the compression fittings.

17 Claims, 3 Drawing Sheets

CABLE CONNECTION SYSTEM

TECHNICAL FIELD

A cable connection system for connecting a metal jacketed electrical cable with a housing.

BACKGROUND OF THE INVENTION

In the oil and gas industry, it is common to connect an electrical cable with one or more electrical instruments which are located or which are intended to be located downhole in a borehole such as a wellbore. The one or more electrical instruments may form a tool string which may be suspended from the electrical cable in the borehole.

The electrical cable is typically connected with the tool string by a cable connection system. The cable connection system typically provides both a mechanical connection and an electrical connection between the electrical cable and the tool string.

The cable connection system may include a housing. The housing may be comprised of a cable head or some other structure which is connected with the tool string and the electrical instruments, or the housing may be integrated into the tool string and/or into one or more of the electrical instruments.

Similar cable connection systems may be used to connect electrical cables with each other (i.e., to splice electrical cables) and/or to connect electrical cables with structures other than tool strings and electrical instruments (such as wellhead equipment).

The electrical cable typically comprises an electrical conductor (including one or more separate electrical wires), an electrical insulating material (including one or more layers of insulation), and a protective sheath.

The protective sheath protects the electrical conductor and the insulating material from the harsh downhole environments.

In some cases, the protective sheath may be comprised of a metal jacket which encapsulates the conductor and the insulating material. The metal jacket may be constructed of any suitable metal material or combination of metal materials including, as non-limiting examples, stainless steel or a metal alloy which can withstand downhole environments. A metal jacketed electrical cable is sometimes referred to as "tube-wire", "metal encapsulated cable", "tubing encapsulated cable", or similar names.

Examples in the prior art of connections between electrical cables and downhole electrical instruments can be found in U.S. Pat. No. 5,833,490 (Bouldin), U.S. Pat. No. 6,362,428 (Pennington), U.S. Pat. No. 7,980,873 (Emerson), U.S. Pat. No. 8,246,371 (Emerson), and U.S. Pat. No. 8,297,345 (Emerson).

There remains a need in the art for connections for metal jacketed electrical cables, and for methods for providing such connections.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention is directed at a cable connection system for connecting a metal jacketed electrical cable with at least one housing, and at methods for providing the cable connection system.

The at least one housing may be comprised of any suitable structure and may be configured for any purpose in which a connection with a metal jacketed cable is required. In some embodiments, the at least one housing may be associated with a tool string and/or with one or more electrical instruments in a tool string. In some embodiments, the at least one housing may be used to splice metal jacketed cables together. In some embodiments, the at least one housing may be associated with a structure other than a tool string including, as a non-limiting example, a wellhead.

In some particular embodiments, the at least one housing may be connected with a tool string comprising one or more electrical instruments, or the at least one housing may be integrated into a tool string and/or into one or more electrical instruments.

In a general system aspect, the invention is a cable connection system for connecting a metal jacketed electrical cable with at least one housing, wherein the cable connection system includes one or more of the following features:

(a) at least one pin electrical connector associated with the cable and at least one socket electrical connector associated with a primary housing, for making an electrical connection between the cable and the primary housing;
(b) an external thread associated with a proximal end of the primary housing which is adapted to accept a compression fitting to make a mechanical connection between the cable and the primary housing;
(c) a rigid electrical insulating sleeve which acts a spacer between the metal jacket and an electrical connector to prevent the electrical connector from contacting the metal jacket; and/or
(d) a secondary housing which is mechanically connected with both the primary housing and the cable.

In a general method aspect, the invention is a method of connecting a metal jacketed electrical cable with at least one housing, wherein the method includes one or more of the following features:

(a) preparing the cable by removing a portion of the metal jacket and the insulating material from a distal end of the cable and making an electrical connection between at least one pin electrical connector and the cable;
(b) preparing the cable by removing a portion of the metal jacket and the insulating material from a distal end of the cable and making an electrical connection between at least one electrical connector and the cable so that a rigid electrical insulating sleeve is interposed between the metal jacket and the at least one electrical connector;
(c) connecting a compression fitting with a primary housing in order to make a mechanical connection between the cable and the primary housing;
(d) connecting at least one pin electrical connector associated with the cable with at least one socket electrical connector associated with the primary housing in order to make an electrical connection between the cable and the primary housing; and/or
(e) mechanically connecting a secondary housing with the primary housing and with the cable.

The features of the invention provide a relatively simple cable connection system which is relatively easy to assemble in the field and which is relatively reliable.

In an exemplary system aspect, the invention is a cable connection system comprising:

(a) a primary housing having a proximal primary housing end and a distal primary housing end, wherein the primary housing defines a primary housing bore extending within the primary housing from the proximal primary housing end, and wherein the proximal primary housing end is comprised of an external primary housing thread;

(b) at least one socket electrical connector contained within the primary housing bore and electrically isolated from the housing;

(c) a metal jacketed electrical cable comprising an electrical conductor, a metal jacket surrounding the conductor, and an electrical insulating material disposed between the conductor and the metal jacket, wherein the cable has a distal cable end, wherein the metal jacket terminates at a jacket termination distanced from the distal cable end, wherein the insulating material terminates at an insulating material termination distanced from the cable end, and wherein the insulating material termination is between the distal cable end and the jacket termination;

(d) at least one pin electrical connector connected with the conductor between the insulating material termination and the distal cable end, wherein the at least one pin electrical connector has a proximal pin connector end, and wherein the proximal pin connector end is adjacent to the insulating material termination;

(e) a rigid electrical insulating sleeve surrounding the insulating material and extending at least a portion of the distance between the jacket termination and the proximal pin connector end, thereby preventing the proximal pin connector end from contacting the jacket termination; and (f) a primary housing compression fitting for mechanically connecting the cable with the primary housing, the primary housing compression fitting comprising a primary housing compression nut having an internal nut thread for engagement with the external primary housing thread, and a primary housing compression ring for providing a primary housing to cable seal between the primary housing bore and the cable.

In a first exemplary method aspect, the invention is a method of connecting a metal jacketed electrical cable with a primary housing, wherein the cable comprises an electrical conductor, a metal jacket surrounding the conductor, and an electrical insulating material disposed between the conductor and the metal jacket, wherein the cable has a distal cable end, wherein the primary housing has a proximal housing end and a distal housing end, wherein the primary housing defines a primary housing bore extending within the primary housing from the proximal primary housing end, wherein the proximal primary housing end is comprised of an external primary housing thread, and wherein at least one socket electrical connector is contained within the primary housing bore and electrically isolated from the housing, the method comprising:

(a) removing a portion of the metal jacket from the distal cable end to provide a jacket termination distanced from the distal cable end;

(b) removing a portion of the insulating material from the distal cable end to provide an insulating material termination distanced from the distal cable end, wherein the insulating material termination is between the distal cable end and the jacket termination;

(c) providing a rigid electrical insulating sleeve;

(d) passing the insulating sleeve over the distal cable end so that the insulating sleeve surrounds the insulating material and extends at least a portion of the distance between the jacket termination and the insulating material termination;

(e) providing at least one pin electrical connector, wherein the at least one pin electrical connector has a proximal pin connector end;

(f) connecting the at least one pin electrical connector with the conductor between the insulating material termination and the distal cable end so that the proximal pin connector end is adjacent to the insulating material termination, so that the insulating sleeve is between the jacket termination and the proximal pin connector end, and so that the insulating sleeve prevents the proximal pin connector end from contacting the jacket termination;

(g) providing a primary housing compression fitting, wherein the primary housing compression fitting comprises a primary housing compression nut having an internal nut thread for engagement with the external primary housing thread, and a primary housing compression ring for providing a primary housing to cable seal between the primary housing bore and the cable;

(h) extending the pin electrical connector through the primary housing compression fitting and into the primary housing bore so that the at least one pin electrical connector electrically connects with the at least one socket electrical connector; and (i) tightening the primary housing compression fitting onto the primary housing by threading the primary housing compression nut onto the external primary housing thread to provide the primary housing to cable seal and to mechanically connect the cable with the primary housing.

The primary housing may be comprised of any suitable structure and may be configured for any purpose in which a connection with a metal jacketed cable is required.

In some embodiments, the primary housing may be associated with a tool string and/or with one or more electrical instruments. In some embodiments, the distal primary housing end may be associated with the tool string and/or the one or more electrical instruments.

In some embodiments, the primary housing may be associated with one or more other electrical cables, so that the primary housing may be used to splice two or more electrical cables together. In some embodiments, the distal primary housing end may be associated with the one or more other electrical cables. In some embodiments, a second cable connection system similar or identical to the cable connection system of the invention may be associated with the distal primary housing end in order to splice the cable with a second metal jacketed electrical cable.

In some embodiments, the primary housing may be associated with one or more structures other than a tool string including, as a non-limiting example, a wellhead. In some embodiments, the distal primary housing end may be associated with the one or more structures.

In some particular embodiments, the primary housing may be connected with a tool string comprising one or more electrical instruments, or the primary housing may be integrated into a tool string and/or into one or more electrical instruments, in some particular embodiments, the primary housing may define an instrument cavity between the one or more socket electrical connectors and the distal primary housing end.

The primary housing may be constructed of any suitable material or combination of materials. The primary housing may be comprised of a single component or piece, or may be comprised of a plurality of components or pieces connected together.

In some embodiments, the primary housing bore may extend through the entire primary housing from the proximal primary housing end to the distal primary housing end. In some embodiments, the primary housing bore may terminate within the primary housing.

In some embodiments, the primary housing may define a feedthrough bore which extends from the at least one socket electrical connector toward the distal housing end.

In some embodiments, the feedthrough bore may extend between the at least one socket electrical connector and an instrument cavity which contains one or more electrical instruments. In some embodiments, the feedthrough bore may extend between the at least one socket electrical connector and a second cable connection system. In some embodiments, the feedthrough bore may extend between the at least one socket electrical connector and a structure other than a tool string.

In some embodiments, the cable connection system may be comprised of at least one electrically conductive feedthrough pin electrically connected with the at least one socket electrical connector and extending through the feedthrough bore.

The at least one feedthrough pin may be comprised of any number of feedthrough pins. In some embodiments in which the at least one feedthrough pin is comprised of a plurality of feedthrough pins, the feedthrough pins may be electrically isolated from each other.

In some embodiments, the cable connection system may be comprised of a feedthrough bore bushing surrounding the feedthrough pins within the feedthrough bore, for electrically isolating the feedthrough pins from the primary housing and/or from each other and for providing a primary feedthrough bore seal between the feedthrough pins and the feedthrough bore.

The feedthrough bore bushing may be constructed of any suitable material or combination of materials. In some embodiments, the feedthrough bore bushing may be constructed of a ceramic/glass material so that the feedthrough bushing is a ceramic bushing.

In some embodiments, the cable connection system may be comprised of an electrically insulating material contained within the feedthrough bore, for providing a secondary feedthrough bore seal between the feedthrough pins and the feedthrough bore.

The electrically insulating material may be comprised of any suitable material or combination of materials. In some embodiments, the electrically insulating material may be an electrically insulating fluid such as an electrically insulating oil which may coat and/or surround the feedthrough bushing.

The at least one socket electrical connector may be comprised of any number of socket electrical connectors. In some embodiments in which the at least one socket electrical connector is comprised of a plurality of socket electrical connectors, the socket electrical connectors may be collected within an electrically insulated spacer in order to electrically isolate the socket electrical connectors from each other.

The socket electrical connectors may be comprised of any suitable female/socket type connector and may be constructed of any suitable material or combination of materials. The socket electrical connectors may be retained in the primary housing bore in any suitable manner which is suitable for electrically isolating the socket electrical connectors from the primary housing. In some embodiments, one or more socket electrical insulators may be contained within the primary housing bore and may surround the socket electrical connectors within the primary housing bore in order to electrically isolate the socket electrical connectors from the primary housing.

The socket electrical connectors and/or the feedthrough pins may be electrically connected directly or indirectly with one or more electrical instruments in a tool string, with one or more other electrical cables, or with one or more structures other than a tool string. The electrical connection between the socket electrical connector and the electrical instruments, other cables and/or other structures may be achieved using any suitable structure, device or apparatus.

The at least one pin electrical connector may be comprised of any number of pin electrical connectors. In some embodiments in which the at least one pin electrical connector is comprised of a plurality of pin electrical connectors, portions of the pin electrical connectors may be collected within an electrically insulated spacer in order to electrically isolate the pin electrical connectors from each other without interfering with electrical connections between the socket electrical connectors and the pin electrical connectors.

The pin electrical connectors may be comprised of any suitable male/pin type connector which is compatible with the socket electrical connectors, and may be constructed of any suitable material or combination of materials. The pin electrical connectors may be connected with the conductor in any suitable manner. In some embodiments, each of the pin electrical connectors may define a cavity and conductor wires may be received within the cavities and retained within the cavities by crimping the pin electrical connectors, by soldering or in some other manner, thereby electrically and mechanically connecting the pin electrical connectors with the cable.

The cable may be constructed of any suitable materials or combination of materials. The conductor may be constructed of any material or combination of materials which is suitable for use as an electrical conductor in downhole environments. The metal jacket may be constructed of any suitable metal or combination of metals including, as non-limiting examples, stainless steel and/or a metal alloy which is suitable for use in downhole environments. The insulating material may be constructed of any material or combination of materials which is suitable for use as an electrical insulating material in downhole environments. The cable may be further comprised of other suitable components, layers, coverings or coatings.

The conductor may be comprised of a single wire or conductor, or may be comprised of a plurality of wires and/or conductors. If the conductor is comprised of a plurality of wires and/or conductors, a plurality of socket electrical connectors, pin electrical connectors and feedthrough pins may be used to provide a plurality of electrical paths within the conductor.

The insulating material may be comprised of a single layer of insulating material or a plurality of layers of insulating material. A plurality of layers of insulating material may be contiguous, or may be separated by one or more layers of other materials or combinations of materials.

The insulating sleeve acts as a spacer to prevent the proximal pin connector end from contacting the jacket termination. The radial dimensions of the insulating sleeve may therefore be selected so that the insulating sleeve is capable of passing over the insulating material but is not capable of passing over the metal jacket or the proximal pin connector end, and the axial dimensions of the insulating sleeve may therefore be selected so that the insulating sleeve fits between the jacket termination and the proximal pin connector end.

The insulating sleeve may be constructed of any material or combination of materials which has electrical properties which prevent an electrical connection between the metal jacket and the at least one pin electrical connector, and which has physical properties which make the insulating sleeve sufficiently rigid to prevent the proximal pin connector end from contacting the jacket termination.

In some particular embodiments, the insulating sleeve may be comprised of, consist of, or consist essentially of a plastic material. In some embodiments, the insulating sleeve may be comprised of a heat shrinkable plastic material. In some particular embodiments, the insulating sleeve may be comprised of consist of or consist essentially of a polyether ether ketone (PEEK) material, a polytetrafluoroethylene (PTFE) material, or a polyvinylidene fluoride (PVDF) material, as non-limiting examples.

The primary housing compression nut may be comprised of any suitable type of fastener which is suitable for use in a compression fitting as a compression nut. The primary housing compression ring may be comprised of any suitable structure, device or apparatus which is suitable for use in a compression fitting as a ferrule, gland or sealing element.

The primary housing compression ring may be constructed of any material or combination of materials which is suitable for use with a metal jacketed electrical cable in a compression fitting including, as a non-limiting example, a metal.

In some embodiments, the cable connection system may be further comprised of a secondary housing. The secondary housing may have a proximal secondary housing end and a distal secondary housing end. The secondary housing may define a secondary housing bore extending within the secondary housing from the distal secondary housing end.

The secondary housing may be constructed of any suitable material or combination of materials. The secondary housing may be comprised of a single component or piece, or may be comprised of a plurality of components or pieces connected together.

In some embodiments, the proximal primary housing end may be received within the secondary housing bore. In some embodiments, the secondary housing may be connected with the primary housing. The secondary housing may be connected with the primary housing in any suitable manner. In some embodiments, the secondary housing may be threadably connected with the primary housing.

In some embodiments, the secondary housing may be connected with the cable. The secondary housing may be connected with the cable in any suitable manner.

In some embodiments, the proximal secondary housing end may be comprised of an external secondary housing thread. In some embodiments, the cable connection system may be further comprised of a secondary housing compression fitting. In some embodiments, the secondary housing compression fitting may be comprised of a secondary housing compression nut having an internal nut thread for engagement with the external secondary housing thread, and a secondary housing compression ring for providing a secondary housing to cable seal between the secondary housing bore and the cable.

The secondary housing compression nut may be comprised of any suitable type of fastener which is suitable for use in a compression fitting as a compression nut. The secondary housing compression ring may be comprised of any suitable structure, device or apparatus which is suitable for use in a compression fitting as a ferrule, gland or sealing element.

The secondary housing compression ring may be constructed of any material or combination of materials which is suitable for use with a metal jacketed electrical cable in a compression fitting including, as a non-limiting example, a metal.

In some embodiments, the cable connection system may be comprised of a secondary housing to primary housing seal between the secondary housing bore and the primary housing. The secondary housing to primary housing seal may be located at any suitable position between the secondary housing bore and the primary housing. In some embodiments, the secondary housing to primary housing seal may be located adjacent to the distal secondary housing end.

In some embodiments, the secondary housing may define a secondary housing port which communicates with the secondary housing bore. The secondary housing port may be comprised of any suitable hole, channel or aperture which facilitates communication with the secondary housing bore from an exterior of the secondary housing.

In some embodiments, the cable connection system may be comprised of a removable plug for sealing the secondary housing port. The removable plug may be comprised of any structure, device or apparatus which is removable and which is suitable for sealing the secondary housing port. In some embodiments, the removable plug may be retained within the secondary housing port with a threaded connection between the removable plug and the secondary housing port.

A second exemplary method aspect of the invention may be applicable if the cable connection system is comprised of a secondary housing, as described above.

In the second exemplary method aspect, the invention is a method of connecting a metal jacketed electrical cable with a primary housing, wherein the cable comprises an electrical conductor, a metal jacket surrounding the conductor, and an electrical insulating material disposed between the conductor and the metal jacket, wherein the cable has a distal cable end, wherein the primary housing has a proximal housing end and a distal housing end, wherein the primary housing defines a primary housing bore extending within the primary housing from the proximal primary housing end, wherein the proximal primary housing end is comprised of an external primary housing thread, and wherein at least one socket electrical connector is contained within the primary housing bore and electrically isolated from the housing, the method comprising:

(a) removing a portion of the metal jacket from the distal cable end to provide a jacket termination distanced from the distal cable end;

(b) removing a portion of the insulating material from the distal cable end to provide an insulating material termination distanced from the distal cable end, wherein the insulating material termination is between the distal cable end and the jacket termination;

(c) providing a rigid electrical insulating sleeve;

(d) passing the insulating sleeve over the distal cable end so that the insulating sleeve surrounds the insulating material and extends at least a portion of the distance between the jacket termination and the insulating material termination;

(e) providing at least one pin electrical connector, wherein the at least one pin electrical connector has a proximal pin connector end;

(f) connecting the at least one pin electrical connector with the conductor between the insulating material termination and the distal cable end so that the proximal pin connector end is adjacent to the insulating material termination, so that the insulating sleeve is between the jacket termination and the proximal pin connector end, and so that the insulating sleeve prevents the proximal pin connector end from contacting the jacket termination;

(g) providing a primary housing compression fitting, wherein the primary housing compression fitting comprises a primary housing compression nut having an internal nut thread for engagement with the external primary housing thread, and a primary housing compression ring for providing a primary housing to cable seal between the primary housing bore and the cable;

(h) providing a secondary housing having a proximal secondary housing end and a distal secondary housing end, wherein the secondary housing defines a secondary housing bore extending within the secondary housing from the distal secondary housing end, and wherein the proximal secondary housing end is comprised of an external secondary housing thread;

(i) providing a secondary housing compression fitting, wherein the secondary housing compression fitting comprises a secondary housing compression nut having an internal nut thread for engagement with the external secondary housing thread, and a secondary housing compression ring for providing a secondary housing to cable seal between the secondary housing bore and the cable;

(j) extending the at least one pin electrical connector through the secondary housing compression fitting, through the secondary housing bore, through the primary housing compression fitting and into the primary housing bore so that the at least one pin electrical connector electrically connects with the at least one socket electrical connector;

(k) tightening the primary housing compression fitting onto the primary housing by threading the primary housing compression nut onto the external primary housing thread to provide the primary housing to cable seal and to mechanically connect the cable with the primary housing;

(l) receiving the proximal primary housing end within the secondary housing bore so that a secondary housing to primary housing seal is provided between the secondary housing bore and the primary housing;

(m) mechanically connecting the secondary housing with the primary housing; and (n) tightening the secondary housing compression fitting onto the secondary housing by threading the secondary housing compression nut onto the external secondary housing thread to provide the secondary housing to cable seal and to mechanically connect the cable with the secondary housing.

In the second exemplary method aspect, the invention may be further comprised of introducing a dielectric material into a secondary housing port defined by the secondary housing, and/or may be further comprised of pressurizing the secondary housing bore through the secondary housing port in order to test the pressure integrity of the cable connection system.

BRIEF DESCRIPTION OF DRAWINGS

Embodiments of the invention will now be described with reference to the accompanying drawings, in which.

DETAILED DESCRIPTION

Figure 1:
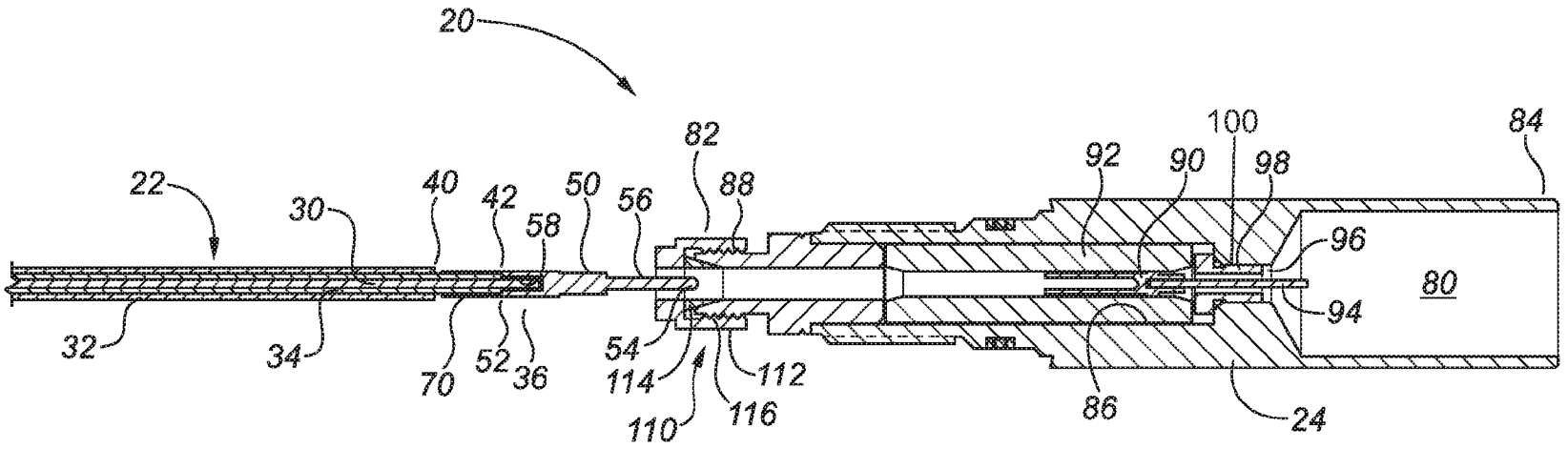
FIG. 1 is a schematic longitudinal section assembly view of an exemplary embodiment of the invention, not comprising a secondary housing, shown partially assembled.
Figure 2:
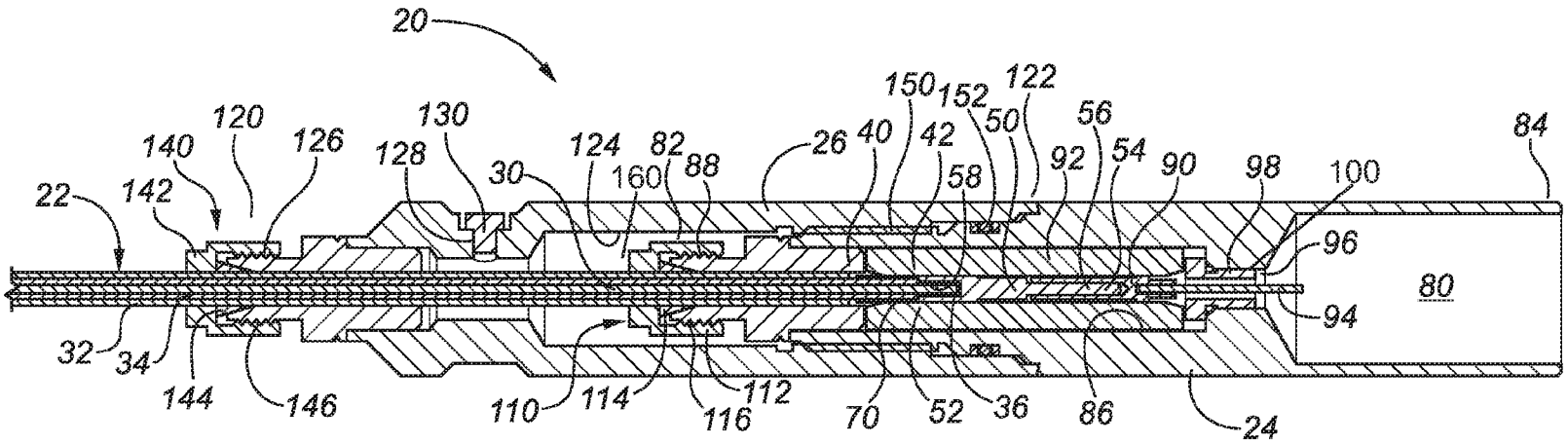
FIG. 2 is a schematic longitudinal section assembly view of an alternate exemplary embodiment of the invention, comprising a secondary housing, shown fully assembled.
Figure 3:
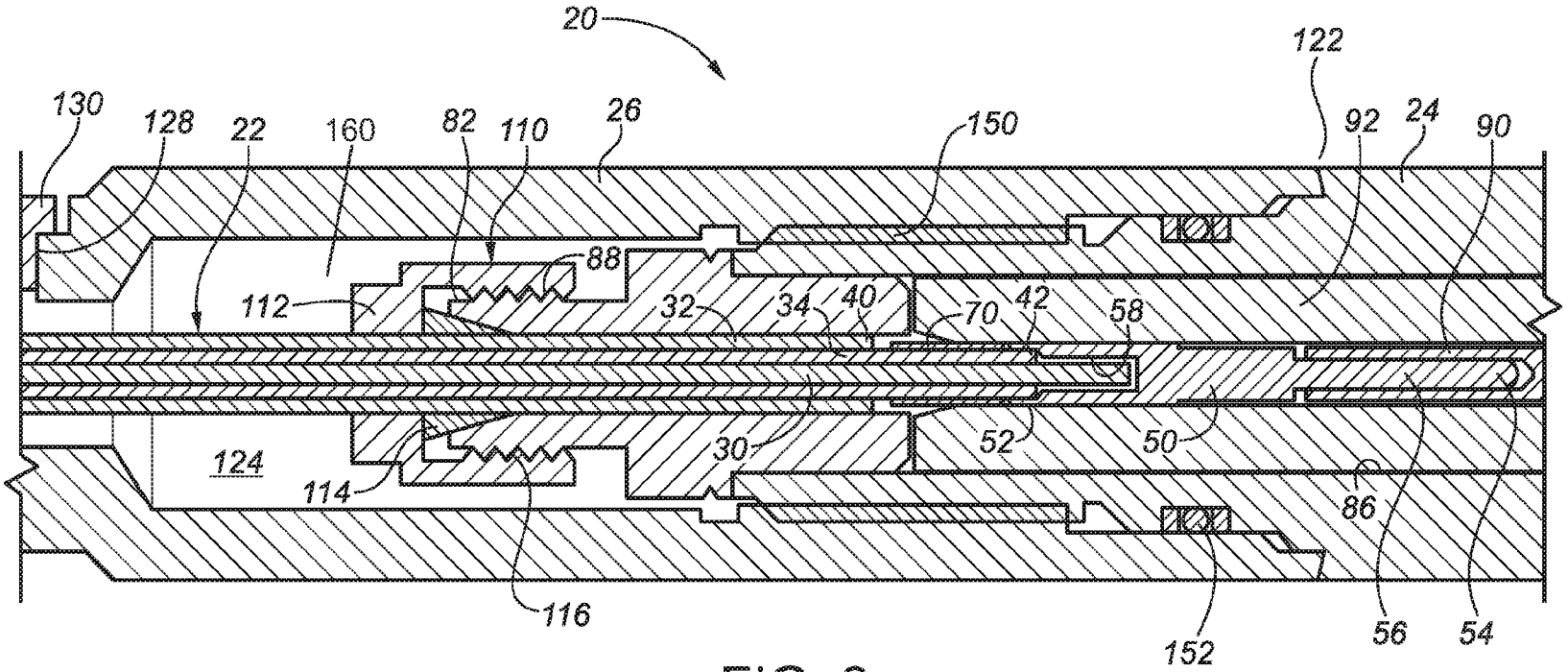
FIG. 3 is an enlarged detail view of the assembled cable, pin electrical connector and insulating sleeve in the alternate exemplary embodiment depicted in FIG. 2.

Referring to FIGS. 1-3, the present invention is directed a cable connection system (20) for connecting a metal jacketed electrical cable (22) with a housing, and at methods for providing the cable connection system.

FIG. 1 depicts a non-limiting first exemplary embodiment of the invention in which the cable (22) is adapted to be connected with a primary housing (24). In FIG. 1, the cable connection system (20) is shown partially assembled.

FIGS. 2-3 depict a non-limiting second exemplary embodiment of the invention in which the cable (22) is adapted to be connected with a primary housing (24) and a secondary housing (26). In FIGS. 2-3, the cable connection system (20) is shown fully assembled.

In the description of the first exemplary embodiment and the second exemplary embodiment which follows, features of the invention which are identical or equivalent in the two exemplary embodiments will be identified with the same reference numbers.

Referring to FIG. 1, the first exemplary embodiment of the cable connection system (20) is shown partially assembled, with the cable (22) not connected with the primary housing (24).

In the first exemplary embodiment, the cable (22) is comprised of a conductor (30), a metal jacket (32) and an electrical insulating material (34) disposed between the conductor (30) and the metal jacket (32). The cable (22) has a distal cable end (36).

In the first exemplary embodiment, the metal jacket (32) terminates at a jacket termination (40) which is distanced from the distal cable end (36). In the first exemplary embodiment, the insulating material (34) terminates at an insulating material termination (42) which is distanced from the distal cable end (36). In the first exemplary embodiment, the insulating material termination (42) is between the distal cable end (36) and the jacket termination (40).

The cable (22) may be supplied with the jacket termination (40) and the insulating material termination (42) or the cable (22) may be prepared for use by stripping the cable (22) to provide the jacket termination (40) and the insulating material termination (42).

As a result of the jacket termination (40) and the insulating material termination (42), the conductor (30) is exposed between the distal cable end (36) and the insulating material termination (42), and the insulating material (34) is exposed between the insulating material termination (42) and the jacket termination (40).

In the first exemplary embodiment, a single pin electrical connector (50) is connected with the cable (22) adjacent to the distal cable end (36). In other embodiments, more than one pin electrical connector may be connected with the cable (22).

The pin electrical connector (50) has a proximal pin connector end (52) and a distal pin connector end (54). In the first exemplary embodiment, the pin electrical connector (50) is comprised of an electrical contact pin (56) at the distal pin connector end (54) and a cavity (58) at the proximal pin connector end (52).

In the first exemplary embodiment, the exposed portion of the conductor (30) is received within the cavity (54) so that the conductor (30) and the pin electrical connector (50) are electrically connected with each other. The pin electrical connector (50) may be mechanically connected with the cable (22) by crimping the pin electrical connector (50), by soldering the conductor (30) within the cavity (54), or in any other suitable manner.

In the first exemplary embodiment, the proximal pin connector end (52) is adjacent to the insulating material termination (42). As a result, there is a gap between the jacket termination (40) and the proximal pin connector end (52), and exposed insulating material (34) visible within the gap.

In the first exemplary embodiment, a rigid electrical insulating sleeve (70) surrounds the exposed insulating material (34) and extends for at least a portion of the distance defined by the gap between the jacket termination (40) and the proximal pin connector end (52). The insulating sleeve (70) acts as a spacer between the jacket termination (40) and the pin electrical connector (50) and prevents the proximal pin connector end (52) from contacting the jacket termination (40). In the first exemplary embodiment, the insulating sleeve may be constructed of polyether ether ketone (PEEK), polytetrafluoroethylene (PTFE), or polyvinylidene fluoride (PVDF) as non-limiting examples, all of which exhibit suitable electrical and physical properties for use as the insulating sleeve (70).

The cable (22) may be supplied with the pin electrical connector (50) and the insulating sleeve (70) already assembled with the cable (22), or the cable (22), the pin electrical connector (50) and the insulating sleeve (70) may be assembled for use when needed.

In the first exemplary embodiment, the primary housing (24) is integrated with one or more electrical instruments (not shown) such as a downhole sensor or sensors. As a result, in the first exemplary embodiment, the primary housing (24) serves as an instrument housing or a component of an instrument housing for the one or more electrical instruments, and defines an instrument cavity (80) for containing the one or more electrical instruments.

In other embodiments, one or more instrument housings may be separate from the primary housing (24), but connected directly or indirectly with the primary housing (24), the primary housing (24) may be adapted for use to connect or splice the cable (22) with one or more other cables (not shown), or the primary housing (24) may be adapted for use to connect the cable (22) with a structure other than a tool string and/or an electrical instrument.

In the first exemplary embodiment, the primary housing (24) is comprised of two primary housing components or pieces which are connected together by welding. In other embodiments, the primary housing (24) may be comprised of a single component or piece or may be comprised of more than two primary housing components or pieces, which may be connected together in any suitable manner.

The primary housing (24) has a proximal primary housing end (82) and a distal primary housing end (84). The primary housing (24) defines a primary housing bore (86) which extends within the primary housing (24) from the proximal primary housing end (82). The proximal primary housing end (82) is comprised of an external primary housing thread (88).

In the first exemplary embodiment, a single socket electrical connector (90) is contained within the primary housing bore (86). In other embodiments, more than one socket electrical connector may be contained within the primary housing bore (86).

A socket electrical insulator (92) is also contained within the primary housing bore (86) and surrounds the socket electrical connector (90) in order to electrically isolate the socket electrical connector (90) from the primary housing (24). The socket electrical connector (90) and the socket electrical insulator (92) may be retained within the primary housing bore (86) in any suitable manner.

In the first exemplary embodiment, a single electrically conductive feedthrough pin (94) extends through a feedthrough bore (96) which is defined by the primary housing (24) between the socket electrical connector (90) and the instrument cavity (80) in order to electrically connect the socket electrical connector (90) with the instrument cavity (80). In other embodiments, more than one feedthrough pin may extend through the feedthrough bore (96).

A feedthrough bore bushing (98) surrounds the feedthrough pin (94) within the feedthrough bore (96) in order to electrically isolate the feedthrough pin (94) from the primary housing (24) and to provide a primary feedthrough bore seal between the feedthrough pin (94) and the feedthrough bore (96). In the first exemplary embodiment, the feedthrough bore bushing (98) is a ceramic bushing constructed of a ceramic/glass material.

In the first exemplary embodiment, the feedthrough bore bushing is surrounded and/or coated with an electrically insulating material (100) such as an electrically insulating oil in order to provide a secondary feedthrough bore seal between the feedthrough pin (94) and the feedthrough bore (96).

In the first exemplary embodiment, one or more electrical instruments contained within the instrument cavity (80) may be electrically connected with the feedthrough pin (94) either directly or indirectly.

The primary housing bore (86) and the socket electrical connector (90) are sized and configured to receive and be compatible with the cable (22) and the pin electrical connector (50).

In the first exemplary embodiment, a primary housing compression fitting (110) is provided for mechanically connecting the cable (22) with the primary housing (24).

In the first exemplary embodiment, the primary housing compression fitting (110) is comprised of a primary housing compression nut (112) and a primary housing compression ring (114). The primary housing compression nut (112) has an internal nut thread (116) for engagement with the external primary housing thread (88) in order to mechanically connect the primary housing compression fitting (110) with the primary housing (24).

In the first exemplary embodiment, the primary housing compression ring (114) is constructed of a metal which is deformable upon tightening of the primary housing compression fitting (110) onto the primary housing (24), and provides a ferrule, gland or sealing element for mechanically connecting the primary housing compression fitting (110) with the cable (22) and for providing a primary housing (24) to cable (22) seal between the primary housing bore (86) and the cable (22).

The first exemplary embodiment of the cable connection system (20) may be assembled in the following non-limiting manner.

If the cable (22), the pin electrical connector (50) and the insulating sleeve (70) are not supplied ready for use in the cable connection system (22), the cable (22), the pin electrical connector (50) and the insulating sleeve (70) may be prepared as follows (if the cable (22), the pin electrical connector (50) and the insulating sleeve (70) are supplied ready for use, 1-5 may be omitted):

1. a portion of the metal jacket (32) may be removed from the distal cable end (36) to provide the jacket termination (40);

2. a portion of the insulating material (34) may be removed from the distal cable end (36) to provide the insulating material termination (42);
3, the insulating sleeve (70) may be passed over the distal cable end (36) so that the insulating sleeve (70) surrounds the exposed insulating material (34) and extends for at least a portion of the distance defined by the gap between the jacket termination (40) and the insulating material termination (42);
4, the pin electrical connector (50) may be connected with the exposed portion of the conductor (30) so that the proximal pin connector end (52) is adjacent to the insulating material termination (42) and so that the insulating sleeve (70) is between the jacket termination (40) and the proximal pin connector end (52); and
5. if the insulating sleeve (70) is constructed of a heat shrinkable material, the insulating sleeve (70) may be heated to shrink the insulating sleeve (70) to a desired dimension (additionally, if the insulating sleeve (70) is constructed of a heat shrinkable material, the insulating sleeve (70) may be passed over the distal cable end (36) either before or after the pin electrical connector (50) is connected with the exposed portion of the conductor (30)).

If the primary housing (24), the socket electrical connector (90) and the feedthrough bore (96) are not supplied ready for use in the cable connection system (22), the primary housing (24), the socket electrical connector (90) and the feedthrough bore (96) may be prepared as follows (if the primary housing (24), the socket electrical connector (90) and the feedthrough bore (96) are supplied ready for use, 6-10 may be omitted):

6. an amount of an electrically insulating material (100) such as an electrically insulating oil may be introduced into the feedthrough bore (96) or applied to the surfaces of the feedthrough bushing (94);
7. the feedthrough bushing (98) may be inserted into the feedthrough bore (96);
8. the feedthrough pin (94) may be inserted into the feedthrough bushing (98); and
9. the socket electrical insulator (92) may be inserted into the primary housing bore (86); and
10. the socket electrical connector (90) may be inserted into the socket electrical insulator (92) in order to electrically connect the socket electrical connector (90) with the feedthrough pin (94).

The cable connection system (20) may then be assembled as follows:

11. the pin electrical connector (50) may be extended through the primary housing compression fitting (110) and into the primary housing bore (86) until that the pin electrical connector (50) electrically connects with the socket electrical connector (90); and
12. the primary housing compression fitting (110) may be tightened onto the primary housing (24) by threading the primary housing compression nut (112) onto the external primary housing thread (88) to provide the primary housing (24) to cable (22) seal and to mechanically connect the cable (22) with the primary housing (24).

The first exemplary embodiment of the cable connection system (20) provides at least three seals between the cable (22) and the primary housing (24). A first seal is provided by the feedthrough bore bushing (98). A second seal is provided by the electrically insulating material (100) which surrounds and/or coats the feedthrough bore bushing (98). A third seal is provided by the primary housing compression fitting (110).

Referring to FIGS. 2-3, the second exemplary embodiment of the cable connection system (20) is shown fully assembled, with the cable (22) connected with both the primary housing (24) and the secondary housing (26), and the secondary housing (26) connected with the primary housing (24).

The principal difference between the second exemplary embodiment of FIGS. 2-3 and the first exemplary embodiment of FIG. 1 is that the second exemplary embodiment further comprises the secondary housing (26). The secondary housing (26) is considered to be optional to the invention, but the second exemplary embodiment provides one or more potential advantages over the first exemplary embodiment.

The description of the second exemplary embodiment which follows is limited to the differences between the second exemplary embodiment and the first exemplary embodiment.

In the second exemplary embodiment, the secondary housing (26) is comprised of two secondary housing components or pieces which are connected together by welding. In other embodiments, the secondary housing (26) may be comprised of a single component or piece or may be comprised of more than two secondary housing components or pieces, which may be connected together in any suitable manner.

The secondary housing (26) has a proximal primary housing end (120) and a distal primary housing end (122). The secondary housing (26) defines a secondary housing bore (124) which extends within the secondary housing (26) from the distal secondary housing end (122). The proximal secondary housing end (120) is comprised of an external secondary housing thread (126).

In the second exemplary embodiment, the secondary housing (26) defines a secondary housing port (128) which communicates with the secondary housing bore (124) from the exterior of the secondary housing (26). In the second exemplary embodiment, the secondary housing port (128) is sealed by a removable plug (130). In the exemplary embodiment, the removable plug (130) is retained within the secondary housing port (128) with a threaded connection between the removable plug (130) and the secondary housing port (128).

In the second exemplary embodiment, a secondary housing compression fitting (140) is provided for mechanically connecting the cable (22) with the secondary housing (26).

In the second exemplary embodiment, the secondary housing compression fitting (140) is comprised of a secondary housing compression nut (142) and a secondary housing compression ring (144). The secondary housing compression nut (142) has an internal nut thread (146) for engagement with the external secondary housing thread (126) in order to mechanically connect the secondary housing compression fitting (140) with the secondary housing (26).

In the second exemplary embodiment, the secondary housing compression ring (144) is constructed of a metal which is deformable upon tightening of the secondary housing compression fitting (140) onto the secondary housing (26), and provides a ferrule, gland or sealing element for mechanically connecting the secondary housing compression fitting (140) with the cable (22) and for providing a secondary housing (26) to cable (22) seal between the secondary housing bore (124) and the cable (22).

In the second exemplary embodiment, the secondary housing bore (124) is sized and configured to receive the proximal primary housing end (82) therein.

In the second exemplary embodiment, the primary housing (24) and the secondary housing (26) are adapted to enable the secondary housing (26) to be mechanically connected with the primary housing (24). In the second exemplary embodiment, a threaded connection (150) is provided between the primary housing (24) and the secondary housing (26) in order to mechanically connect the secondary housing (26) with the primary housing (24).

In the second exemplary embodiment, the primary housing (24) and the secondary housing (26) are adapted to provide a secondary housing (26) to primary housing (24) seal between the secondary housing bore (124) and the primary housing (24). In the second exemplary embodiment, the secondary housing (26) to primary housing (24) seal is provided by one or more O-rings (152) which are contained in recesses in an exterior surface of the primary housing (24).

In the second exemplary embodiment, the secondary housing (26) to primary housing (24) seal is located adjacent to the distal secondary housing end (122). In the second exemplary embodiment, the threaded connection (150) between the primary housing (24) and the secondary housing (26) is located between the proximal secondary housing end (120) and the secondary housing (26) to primary housing (24) seal.

In the second exemplary embodiment, the secondary housing (26) is sealed relative to the primary housing (24) by the one or more O-rings (152), and is sealed relative to the cable (22) by the secondary housing compression fitting (140). As a result, in the second exemplary embodiment, a dielectric material (160) can be retained within the secondary housing bore (124), and/or the secondary housing bore (124) can be pressurized to test the pressure integrity of the cable connection system (20).

In the second exemplary embodiment, the dielectric material (160) may be introduced into the secondary housing bore (124) via the secondary housing port (128). In other embodiments, the dielectric material (160) may alternately be introduced into the secondary housing bore (124) during assembly of the cable connection system (20) without using the secondary housing port (128).

In the second exemplary embodiment, the secondary housing bore (124) may be pressurized to test the pressure integrity of the cable connection system (20) via the secondary housing port (128).

In the second exemplary embodiment, the cable (22) is also mechanically connected with the secondary housing (26) by the secondary housing compression fitting (140), with the result that the cable (22) is not supported within the cable connection system (20) solely by the primary housing compression tilting (110).

The second exemplary embodiment of the cable connection system (20) may be assembled in the following non-limiting manner.

If the cable (22), the pin electrical connector (50) and the insulating sleeve (70) are not supplied ready for use in the cable connection system (22), the cable (22), the pin electrical connector (50) and the insulating sleeve (70) may be prepared as follows (if the cable (22), the pin electrical connector (50) and the insulating sleeve (70) are supplied ready for use, 1-5 may be omitted):

1. a portion of the metal jacket (32) may be removed from the distal cable end (36) to provide the jacket termination (40);
2. a portion of the insulating material (34) may be removed from the distal cable end (36) to provide the insulating material termination (42);
3. the insulating sleeve (70) may be passed over the distal cable end (36) so that the insulating sleeve (70) surrounds the exposed insulating material (34) and extends for at least a portion of the distance defined by the gap between the jacket termination (40) and the insulating material termination (42);
4. the pin electrical connector (50) may be connected with the exposed portion of the conductor (30) so that the proximal pin connector end (52) is adjacent to the insulating material termination (42) and so that the insulating sleeve (70) is between the jacket termination (40) and the proximal pin connector end (52); and
5. if the insulating sleeve (70) is constructed of a heat shrinkable material, the insulating sleeve (70) may be heated to shrink the insulating sleeve (70) to a desired dimension (additionally, if the insulating sleeve (70) is constructed of a heat shrinkable material, the insulating sleeve (70) may be passed over the distal cable end (36) either before or after the pin electrical connector (50) is connected with the exposed portion of the conductor (30)).

If the primary housing (24), the socket electrical connector (90) and the feedthrough bore (96) are not supplied ready for use in the cable connection system (22), the primary housing (24), the socket electrical connector (90) and the feedthrough bore (96) may be prepared as follows (if the primary housing (24), the socket electrical connector (90) and the feedthrough bore (96) are supplied ready for use, 6-10 may be omitted):

6. an amount of an electrically insulating material (100) such as an electrically insulating oil may be introduced into the feedthrough bore (96) or applied to the surfaces of the feedthrough bushing (94);
7. the feedthrough bushing (98) may be inserted into the feedthrough bore (96);
8. the feedthrough pin (94) may be inserted into the feedthrough hushing (98); and
9. the socket electrical insulator (92) may be inserted into the primary housing bore (86); and
10. the socket electrical connector (90) may be inserted into the socket electrical insulator (92) in order to electrically connect the socket electrical connector (90) with the feedthrough pin (94).

The cable connection system (20) may then be assembled as follows:

11. the pin electrical connector (50) may be extended through the secondary housing compression fitting (140), through the secondary housing bore (124), through the primary housing compression fitting (110) and into the primary housing bore (86) until that the pin electrical connector (50) electrically connects with the socket electrical connector (90);
12. the primary housing compression fitting (110) may be tightened onto the primary housing (24) by threading the primary housing compression nut (112) onto the external primary housing thread (88) to provide the primary housing (24) to cable (22) seal and to mechanically connect the cable (22) with the primary housing (24);
13. the proximal primary housing end (82) may be received within the secondary housing bore (124);
14. the secondary housing (26) may be mechanically connected with the primary housing (24) by making up the threaded connection (150) between the primary housing (24) and the secondary housing (26); and
15. the secondary housing compression fitting (140) may be tightened onto the secondary housing (26) by threading the secondary housing compression nut (142) onto the external secondary housing thread (126) to provide the secondary housing (26) to cable (22) seal and to mechanically connect the cable (22) with the secondary housing (26).

In the second exemplary embodiment, a dielectric material (160) may be introduced into the assembled cable connection system (20) in the following manner:

16. the removable plug (130) may be removed from the secondary housing port (128);
17. the dielectric material (160) may be introduced into the secondary housing bore (124) via the secondary housing port (128); and
18. the removable plug (130) may be reinserted in the secondary housing port (128) in order to reseal the secondary housing port (128).

In the second exemplary embodiment, the secondary housing bore (124) may be pressurized to test the pressure integrity of the assembled cable connection system (20) in the following manner:

19. the removable plug (130) may be removed from the secondary housing port (128);
20. a source of pressure may be connected with the secondary housing port (128);
21. the pressure integrity of the cable connection system (20) may be assessed;
22. the source of pressure may be disconnected from the secondary housing port (128); and
23. the removable plug (130) may be reinserted in the secondary housing port (128) in order to reseal the secondary housing port (128).

The second exemplary embodiment of the cable connection system (20) provides at least five seals between the cable (22) and the primary housing (24). A first seal is provided by the feedthrough bore bushing (98). A second seal is provided by the electrically insulating material (100) which surrounds and/or coats the feedthrough bore bushing (98). A third seal is provided by the primary housing compression fitting (110). A fourth seal is provided by the secondary housing compression fitting (140). A fifth seal is provided by the dielectric material (160) which may be introduced into the secondary housing bore (124).

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. A cable connection system comprising:

(a) a primary housing having a proximal primary housing end and a distal primary housing end, wherein the primary housing defines a primary housing bore extending within the primary housing from the proximal primary housing end, and wherein the proximal primary housing end is comprised of an external primary housing thread;

(b) at least one socket electrical connector contained within the primary housing bore and electrically isolated from the housing;

(c) a metal jacketed electrical cable comprising an electrical conductor, a metal jacket surrounding the conductor, and an electrical insulating material disposed between the conductor and the metal jacket, wherein the cable has a distal cable end, wherein the metal jacket terminates at a jacket termination distanced from the distal cable end, wherein the insulating material terminates at an insulating material termination distanced from the cable end, and wherein the insulating material termination is between the distal cable end and the jacket termination;

(d) at least one pin electrical connector connected with the conductor between the insulating material termination and the distal cable end, wherein the at least one pin electrical connector has a proximal pin connector end, and wherein the proximal pin connector end is adjacent to the insulating material termination;

(e) a rigid electrical insulating sleeve surrounding the insulating material and extending at least a portion of the distance between the jacket termination and the proximal pin connector end, thereby preventing the proximal pin connector end from contacting the jacket termination; and (f) a primary housing compression fitting for mechanically connecting the cable with the primary housing, the primary housing compression fitting comprising a primary housing compression nut having an internal nut thread for engagement with the external primary housing thread, and a primary housing compression ring for providing a primary housing to cable seal between the primary housing bore and the cable.

2. The cable connection system as claimed in claim 1 wherein the insulating sleeve is comprised of a plastic material.

3. The cable connection system as claimed in claim 2 wherein the insulating sleeve is comprised of a polyether ether ketone material.

4. The cable connection system as claimed in claim 1, further comprising a secondary housing having a proximal secondary housing end and a distal secondary housing end, wherein the secondary housing defines a secondary housing bore extending within the secondary housing from the distal secondary housing end, wherein the proximal primary housing end is received within the secondary housing bore, and wherein the secondary housing is mechanically connected with the primary housing.

5. The cable connection system as claimed in claim 4 wherein the proximal secondary housing end is comprised of an external secondary housing thread, further comprising a secondary housing compression fitting for mechanically connecting the cable with the secondary housing, the secondary housing compression fitting comprising a secondary housing compression nut having an internal nut thread for engagement with the external secondary housing thread, and a secondary housing compression ring for providing a secondary housing to cable seal between the secondary housing bore and the cable.

6. The cable connection system as claimed in claim 5, further comprising a secondary housing to primary housing seal between the secondary housing bore and the primary housing.

7. The cable connection system as claimed in claim 5 wherein the secondary housing defines a secondary housing port which communicates with the secondary housing bore, further comprising a removable plug for sealing the secondary housing port.

8. The cable connection system as claimed in claim 6 wherein the secondary housing to primary housing seal is located adjacent to the distal secondary housing end.

9. The cable connection system as claimed in claim 8 wherein the secondary housing is threadably connected with the primary housing.

10. The cable connection system as claimed in claim 1 wherein the primary housing defines a feedthrough bore which extends from the at least one socket electrical connector toward the distal housing end and wherein the cable connection system further comprises:

(g) at least one electrically conductive feedthrough pin electrically connected with the at least one socket electrical connector and extending through the feedthrough bore; and (h) a feedthrough bore bushing surrounding the at least one feedthrough pin within the feedthrough bore, for electrically isolating the at least one feedthrough pin from the primary housing and for providing a primary feedthrough bore seal between the at least one feedthrough pin and the feedthrough bore.

11. The cable connection system as claimed in claim 10 wherein the feedthrough bore bushing is a ceramic bushing.

12. The cable connection system as claimed in claim 10, further comprising an amount of an electrically insulating fluid contained within the feedthrough bore, for providing a secondary feedthrough bore seal between the at least one feedthrough pin and the feedthrough bore.

13. The cable connection system as claimed in claim 12 wherein the electrically insulating fluid is an electrically insulating oil.

14. A method of connecting a metal jacketed electrical cable with a primary housing, wherein the cable comprises an electrical conductor, a metal jacket surrounding the conductor, and an electrical insulating material disposed between the conductor and the metal jacket, wherein the cable has a distal cable end, wherein the primary housing has a proximal housing end and a distal housing end, wherein the primary housing defines a primary housing bore extending within the primary housing from the proximal primary housing end, wherein the proximal primary housing end is comprised of an external primary housing thread, and wherein at least one socket electrical connector is contained within the primary housing bore and electrically isolated from the housing, the method comprising:

(a) removing a portion of the metal jacket from the distal cable end to provide a jacket termination distanced from the distal cable end;

(b) removing a portion of the insulating material from the distal cable end to provide an insulating material termination distanced from the distal cable end, wherein the insulating material termination is between the distal cable end and the jacket termination;

(c) providing a rigid electrical insulating sleeve;

(d) passing the insulating sleeve over the distal cable end so that the insulating sleeve surrounds the insulating material and extends at least a portion of the distance between the jacket termination and the insulating material termination;

(e) providing at least one pin electrical connector, wherein the at least one pin electrical connector has a proximal pin connector end;

(f) connecting the at least one pin electrical connector with the conductor between the insulating material termination and the distal cable end so that the proximal pin connector end is adjacent to the insulating material termination, so that the insulating sleeve is between the jacket termination and the proximal pin connector end, and so that the insulating sleeve prevents the proximal pin connector end from contacting the jacket termination;

(g) providing a primary housing compression fitting, wherein the primary housing compression fitting comprises a primary housing compression nut having an internal nut thread for engagement with the external primary housing thread, and a primary housing compression ring for providing a primary housing to cable seal between the primary housing bore and the cable;

(h) extending the at least one pin electrical connector through the primary housing compression fitting and into the primary housing bore so that the at least one pin electrical connector electrically connects with the at least one socket electrical connector; and (i) tightening the primary housing compression fitting onto the primary housing by threading the primary housing compression nut onto the external primary housing thread to provide the primary housing to cable seal and to mechanically connect the cable with the primary housing.

15. A method of connecting a metal jacketed electrical cable with a primary housing, wherein the cable comprises an electrical conductor, a metal jacket surrounding the conductor, and an electrical insulating material disposed between the conductor and the metal jacket, wherein the cable has a distal cable end, wherein the primary housing has a proximal housing end and a distal housing end, wherein the primary housing defines a primary housing bore extending within the primary housing from the proximal primary housing end, wherein the proximal primary housing end is comprised of an external primary housing thread, and wherein at least one socket electrical connector is contained within the primary housing bore and electrically isolated from the housing, the method comprising:

(a) removing a portion of the metal jacket from the distal cable end to provide a jacket termination distanced from the distal cable end;

(b) removing a portion of the insulating material from the distal cable end to provide an insulating material termination distanced from the distal cable end, wherein the insulating material termination is between the distal cable end and the jacket termination;

(c) providing a rigid electrical insulating sleeve;

(d) passing the insulating sleeve over the distal cable end so that the insulating sleeve surrounds the insulating material and extends at least a portion of the distance between the jacket termination and the insulating material termination;

(e) providing at least one pin electrical connector, wherein the at least one pin electrical connector has a proximal pin connector end;

(f) connecting the at least one pin electrical connector with the conductor between the insulating material termination and the distal cable end so that the proximal pin connector end is adjacent to the insulating material termination, so that the insulating sleeve is between the jacket termination and the proximal pin connector end, and so that the insulating sleeve prevents the proximal pin connector end from contacting the jacket termination;

(g) providing a primary housing compression fitting, wherein the primary housing compression fitting comprises a primary housing compression nut having an internal nut thread for engagement with the external primary housing thread, and a primary housing compression ring for providing a primary housing to cable seal between the primary housing bore and the cable;

(h) providing a secondary housing having a proximal secondary housing end and a distal secondary housing end, wherein the secondary housing defines a secondary housing bore extending within the secondary housing from the distal secondary housing end, and wherein the proximal secondary housing end is comprised of an external secondary housing thread;

(i) providing a secondary housing compression fitting, wherein the secondary housing compression fitting comprises a secondary housing compression nut having an internal nut thread for engagement with the external secondary housing thread, and a secondary housing compression ring for providing a secondary housing to cable seal between the secondary housing bore and the cable;

(j) extending the at least one pin electrical connector through the secondary housing compression fitting, through the secondary housing bore, through the primary housing compression fitting and into the primary housing bore so that the at least one pin electrical connector electrically connects with the at least one socket electrical connector;

(k) tightening the primary housing compression fitting onto the primary housing by threading the primary housing compression nut onto the external primary housing thread to provide the primary housing to cable seal and to mechanically connect the cable with the primary housing;

(l) receiving the proximal primary housing end within the secondary housing bore so that a secondary housing to primary housing seal is provided between the secondary housing bore and the primary housing;

(m) mechanically connecting the secondary housing with the primary housing; and (n) tightening the secondary housing compression fitting onto the secondary housing by threading the secondary housing compression nut onto the external secondary housing thread to provide the secondary housing to cable seal and to mechanically connect the cable with the secondary housing.

16. The method as claimed in claim 15 wherein the secondary housing defines a secondary housing port which communicates with the secondary housing bore, further comprising introducing a dielectric material into the secondary housing bore through the secondary housing port.

17. The method as claimed in claim 15 wherein the secondary housing defines a secondary housing port which communicates with the secondary housing bore, further comprising pressurizing the secondary housing bore through the secondary housing port in order to test the pressure integrity of the cable connection system.

* * * * *